US005427220A

United States Patent [19]

Nishiumi et al.

[11] Patent Number: 5,427,220

[45] Date of Patent: Jun. 27, 1995

[54] COIN PROCESSING APPARATUS

[75] Inventors: Kenji Nishiumi, Hanno; Shusuke Sumi, Tsurugashima, both of Japan

[73] Assignee: Kabushiki Kaisha Nippon Conlux, Japan

[21] Appl. No.: 27,810

[22] Filed: Mar. 8, 1993

[30] Foreign Application Priority Data

Mar. 13, 1992 [JP] Japan ..... 4-055534
Mar. 13, 1992 [JP] Japan ..... 4-055535

[51] Int. Cl.[6] ..... G07D 5/08; G07F 1/04
[52] U.S. Cl. ..... 194/317; 194/348
[58] Field of Search ..... 194/317, 318, 319, 348; 453/3, 9, 17

[56] References Cited

U.S. PATENT DOCUMENTS

| | | | |
|---|---|---|---|
| 3,791,503 | 2/1974 | Haeusser et al. . | |
| 3,844,297 | 10/1974 | Lautzenhiser . | |
| 3,906,965 | 9/1975 | Luyben et al. . | |
| 3,907,088 | 9/1975 | Burzen | 194/244 |
| 3,948,377 | 4/1976 | Hayashi et al. . | |
| 4,089,400 | 5/1978 | Gregory, Jr. . | |
| 4,095,607 | 6/1978 | Newton et al. . | |
| 4,106,610 | 8/1978 | Heiman | 194/317 |
| 4,228,811 | 10/1980 | Tanaka et al. | 194/317 X |
| 4,286,703 | 9/1981 | Schuller et al. . | |
| 4,367,760 | 1/1983 | Thomas et al. . | |
| 4,374,557 | 2/1983 | Sugimoto et al. . | |
| 4,625,851 | 12/1986 | Johnson et al. . | |
| 4,706,202 | 11/1987 | Kobayashi et al. . | |
| 4,850,469 | 7/1989 | Hayashi et al. . | |
| 5,027,937 | 7/1991 | Parish et al. . | |
| 5,092,816 | 3/1992 | Levasseur . | |

FOREIGN PATENT DOCUMENTS

| | | | |
|---|---|---|---|
| 0042591 | 6/1981 | European Pat. Off. . | |
| 0062411 | 3/1982 | European Pat. Off. . | |
| 2326344 | 12/1974 | Germany | 194/348 |
| 48-95896 | 12/1973 | Japan . | |
| 1-259485 | 10/1989 | Japan . | |
| 1-311396 | 12/1989 | Japan . | |
| 2-76092 | 3/1990 | Japan . | |
| 2-76093 | 3/1990 | Japan | 194/348 |
| 2-76094 | 3/1990 | Japan . | |
| 4-33194 | 2/1992 | Japan | 194/348 |

*Primary Examiner*—F. J. Bartuska
*Attorney, Agent, or Firm*—Welsh & Katz, Ltd.

[57] ABSTRACT

A coin processing apparatus which comprises a coin selecting section for determining whether put-in coins are genuine or not and denominations of the coins determined as genuine, a coin accommodating section for accommodating the genuine coins selected by the coin selecting section, and a coin payment section for paying out coins having denominations corresponding to an amount of change from the coin accommodating section, in which the coin accommodating section is formed at the lower portion of a single housing and the coin selecting section is formed by an inner wall face of the housing having a part of the coin selecting section and by a cover having another part of the coin selecting section on its back face, the cover being adapted for covering the inner wall face of the housing, and in which a rib is formed on an upper surface of the housing, for guiding liquid fell on the upper surface of the housing to both sides of the housing and, the coin selecting section is provided with a liquid collector, a discharge path and a guide groove for rapidly discharging liquid poured into a coin slot to the outside of the coin processing apparatus.

32 Claims, 15 Drawing Sheets

COIN PROCESSING APPARATUS

BACKGROUND OF THE INVENTION

1. Field of the Invention

The present invention relates to coin processing apparatus used in vending machines, money exchangers, service devices, etc., and adapted to separate and accommodate put-in coins in accordance with denominations and pay out those separated and accommodated coins as change.

2. Description of the Related Art

Generally, vending machines, money exchangers, service devices, etc., include a coin processing apparatus for separating and accommodating put-in coins in accordance with denominations and paying out those coins as change.

FIG. 17 is a decomposed perspective view of a conventional coin processing apparatus 100.

This coin processing apparatus 100 is mainly composed of three independent units, i.e., a coin payment unit 102 configured by a housing having a substantially -shaped sectional configuration and provided with a pay-out mechanism 101 at its lower portion for paying out change, a coin accommodating unit 103 composed of coin tubes to be mounted above the pay-out mechanism 101 of the coin payment unit 102 and, a coin selecting unit 104 to be mounted above the coin accommodating unit 103.

Among these units constituting the coin processing apparatus 100, the coin accommodating unit 103 and the coin selecting unit 104 are arranged to be mounted within the coin payment unit 102 as shown by arrows when they are used. In other words, the coin accommodating unit 103 and the coin selecting unit 104 are formed separately from the coin payment unit 102 and are configured to be detachably mounted to the coin payment unit 102.

When a coin is put into the coin processing apparatus 100, the coin first enters into the coin selecting unit 104 and checked whether a genuine one or not, and if it is a genuine one, it is classified in accordance with its denomination. The genuine coin is then accommodated in accordance with its denomination in the coin accommodating unit 103 disposed below the coin selecting unit 104. When denominations of change are determined, coins accommodated in the coin accommodating unit 103 are paid out for an amount corresponding to the sum of change from the lower portion of the coin processing apparatus 100 by the coin payment mechanism 101 formed at the lowermost position of the coin payment unit 102.

Since the conventional coin processing apparatus 100 is configured such that each of the units are separately provided and the coin selecting unit 104 having a complicated configuration is detachably mounted to the coin payment unit 102, the entire configuration of the coin processing apparatus 100 becomes extremely complicated. Further, a large number of mechanical and electrical parts (connectors, connecting elements, etc.) for connecting the respective units (particularly the coin selecting unit) to the coin payment unit 102 are required and thus the manufacturing cost of the entire coin processing apparatus 100 becomes high.

According to the conventional coin processing apparatus 100 as described above, complicated coin paths for selection of coins are formed in the coin selecting unit 104. Since coins roll down along the coin paths, if liquid such as soft drink or cleaning detergent is poured into a coin slot of a vending machine, for example, the liquid will flow along the upper surface of the coin processing apparatus 100 and along the coin paths of the coin selecting unit 104. When adhesive liquid such as cleaning detergent flows through the coin paths in the coin selecting unit, it will adhere to selection units such as coin separating levers disposed in the coin paths whereby the normal operation of such selection units is hindered and hence the selecting function of the coin processing apparatus 100 is deteriorated. When such adhesive liquid adhering to the selection units is dried, the operation of these selection units may be locked and the function of the coin processing apparatus 100 itself may be stopped. Further the liquid may flow into the coin tubes which function as the coin accommodating unit 103 and also into the coin payment unit 102 causing short-circuit of electronic circuits and a payment motor which results in a malfunction of the apparatus.

SUMMARY OF THE INVENTION

In view of such problems, the present invention is made to provide a coin processing apparatus having a simple structure with less parts.

In order to achieve such objects, according to the present invention, a coin processing apparatus comprises a coin selecting section for determining whether coins put-in are genuine or not and denominations of coins determined as genuine and guiding false coins to a predetermined coin path assigned for the false coins and guiding the genuine coins to respective predetermined coin paths assigned for the respective denominations in accordance with the denominations, a coin accommodating section for accommodating the genuine coins selected by the coin selecting section separately for the respective denominations, and a coin payment section for paying out coins of denominations corresponding to an amount of change from the coin accommodating section, in which the coin payment section is formed at a lower portion of a single housing and the coin selecting section is formed by an inner wall face of the single housing which is provided with a part of the coin selecting section on the inner wall face thereof and by a cover which is provided with another part of the coin selecting section and which is adapted for covering the inner wall face of the single housing.

It is another object of the present invention to provide a coin processing apparatus which prevents liquid poured into the coin slot from adhering to selection members disposed in the apparatus.

In order to achieve the above object, the coin processing apparatus includes a rib formed on an upper surface of the housing which constitutes the main body of the coin processing apparatus, for guiding the liquid to both sides of the housing, a guide groove having dams for guiding the liquid which is formed on an inner wall face of the coin path communicating with the coin slot of the coin selecting section along a substantially vertically downward direction of the coin slot, a liquid collector provided below the coin path communicating with the coin slot for collecting the liquid falling along the guide groove, and a discharge path communicating with the liquid collector for discharging the liquid collected in the liquid collector to the outside of the coin selecting section.

Other objects and effects of the present invention will be easily confirmed by the following detailed description and accompanying drawings.

DESCRIPTION OF THE PREFERRED EMBODIMENT

One embodiment of a coin processing apparatus according to the present invention will be described in detail below.

Figure 1:
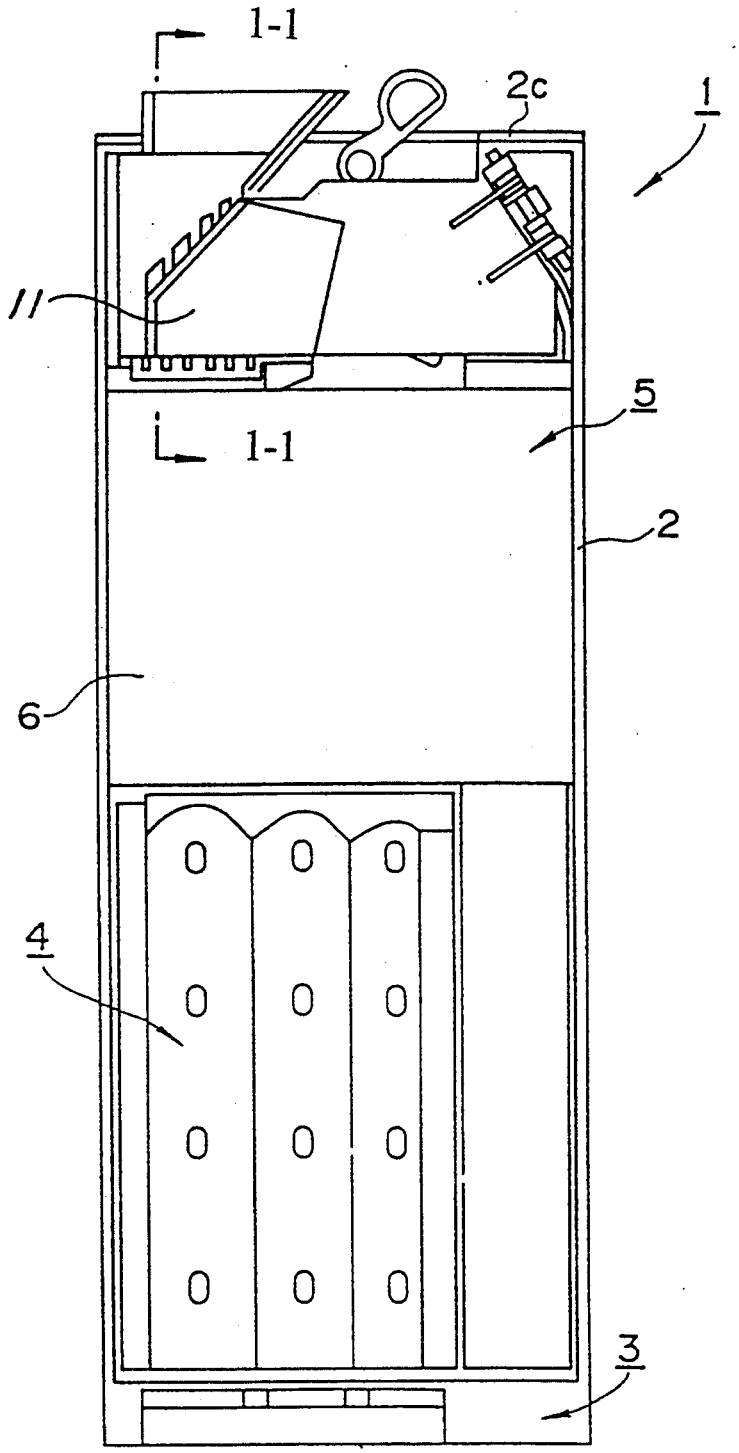
FIG. 1 is a schematic front view of a coin processing apparatus according to the present invention.
Figure 2:
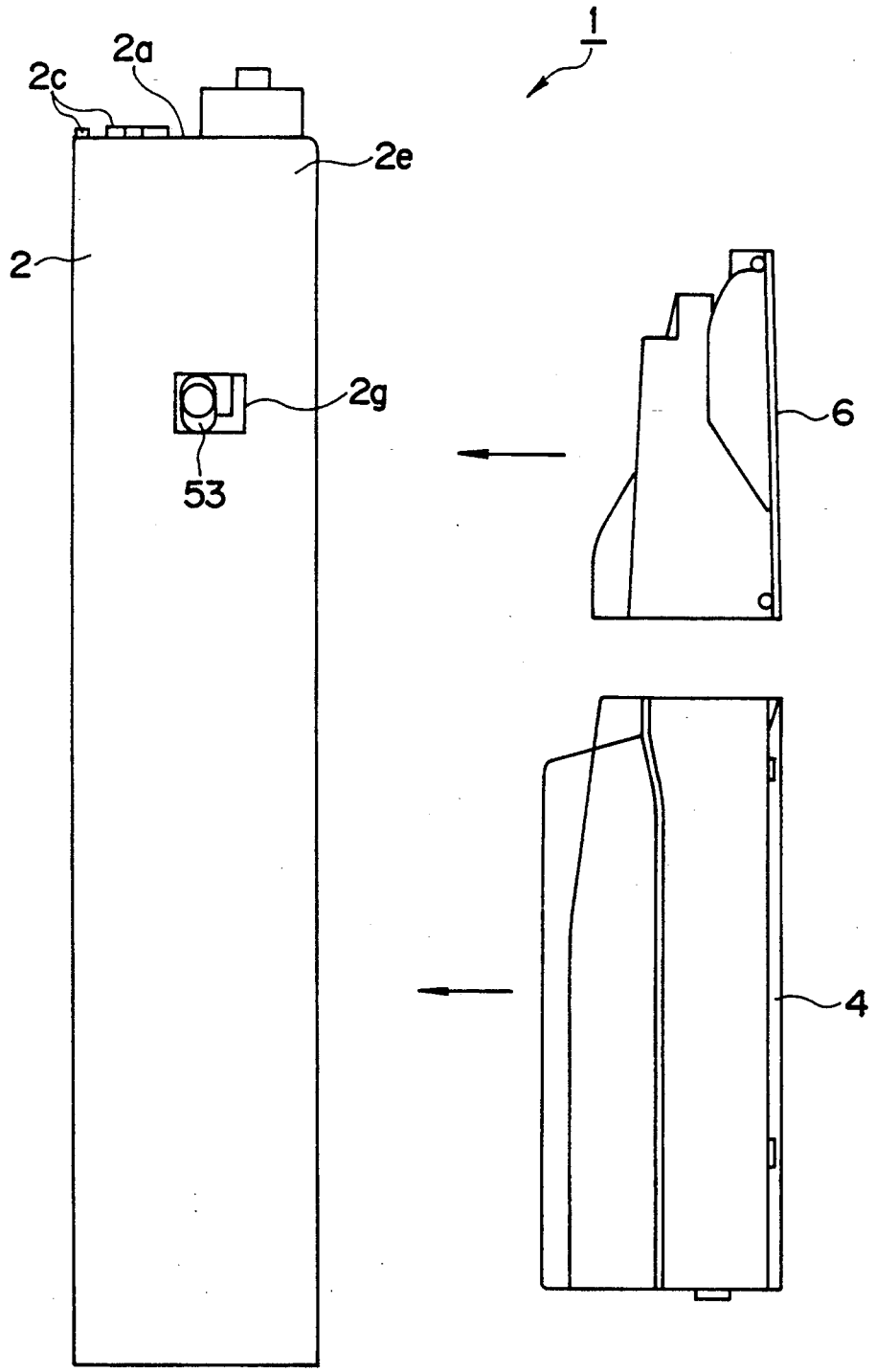
FIG. 2 is a decomposed side view of the coin processing apparatus of FIG. 1.

FIGS. 1 and 2 are a front view and a decomposed side view, respectively, of a coin processing apparatus 1 according to the present invention.

The coin processing apparatus 1 is configured by a single housing 2 having a substantially-shaped sectional configuration which constitutes a main body of the coin processing apparatus. On the lower portion of the housing 2, a coin payment section 3 is formed integrally with the housing 2 and on the upper portion of the housing 2, a coin selecting section 5 is defined (formed) by the inner wall face of the housing 2 having a part of the coin selecting section on the inner wall face thereof and by a cover having another part of the coin selecting section on its back face and which is adapted for covering the inner wall face of the housing 2. Further, a coin accommodating section 4 comprising coin tubes is disposed at a position between a substantially center and the lower portion of the housing 2.

As shown in FIG. 2, the main composing elements of the coin processing apparatus 1 are the housing 2, the coin accommodating section 4 which comprises the coin tubes and which is mounted at the position between the substantially center and the lower portion of the housing 2, a chute plate 6 which constitutes a mart of the coin selecting section 5 and which is one of the covers for covering the housing 2.

Figure 3:
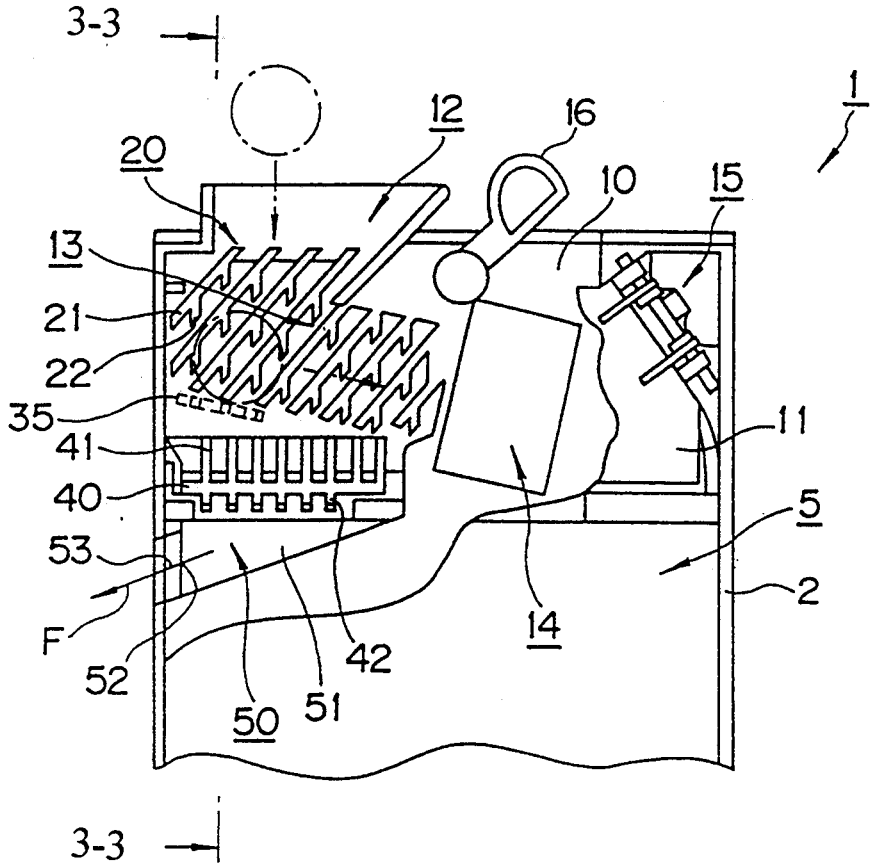
FIG. 3 is a cutaway fragmentary view of the essential portion of a coin selecting section.

As shown in FIG. 3 which is a cutaway enlarged view of the essential portion of the coin selecting section 5, a coin slot 12 of the coin selecting section 5 formed on the upper portion of the housing 2 is provided between a gate plate 11 which is the other one of the covers openably covering the upper portion of the housing 2 and a main plate 10 which constitutes the inner wall face of the housing 2. A first tilted coin path 13 is formed substantially vertically under the coin slot 12 such that it communicates with a lower end of the coin slot 12 and rolls a coin (shown by a dot-dashed line) put therein from the coin slot 12 toward rightward in FIG. 3. The first coin path 13 is also formed between the gate plate 11 and the main plate 10.

A coil sensor 14 is disposed in the middle of the first coin path 13 which determines whether the coin put-in is a genuine one or not and determines the denomination of the coin regarded as a genuine one during passage of the coin. The coil sensor 14 includes an oscillating coil and a receiving coin (both are not shown) disposed opposite to each other with a predetermined spacing therebetween for allowing the put-in coin to pass through the spacing. The coil sensor 14 is detachably mounted to the main plate 10.

Figure 4:
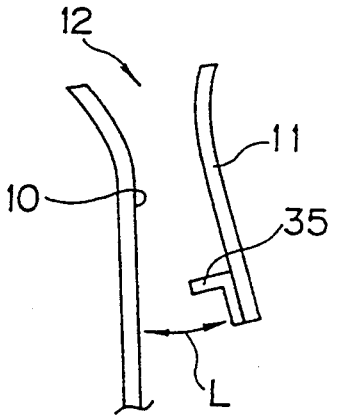
FIG. 4 is a schematic cross-sectional view taken along the line 3—3 of FIG. 3.

A pivot 15 of the gate plate 11 which opens and closes the coin slot 12 is provided tilted at an upper right corner of the gate plate 11, as shown in FIG. 3. Thus, when a gate lever 16 is turned to widen the space between the main plate 10 and the gate plate 11 when the coin put-in is clogged in the first coin path 13, the gate plate 11 is tilted to open to thereby ensure a large opening/closing stroke L of a lower end of the gate plate 11 so as to quickly discharge a coin clogged in the coin slot 12 and the first coin path 13 toward downward of the first coin path 13, as shown in FIG. 4 which is a conceptual view taken along the line M—M of FIG. 3.

Figure 5:
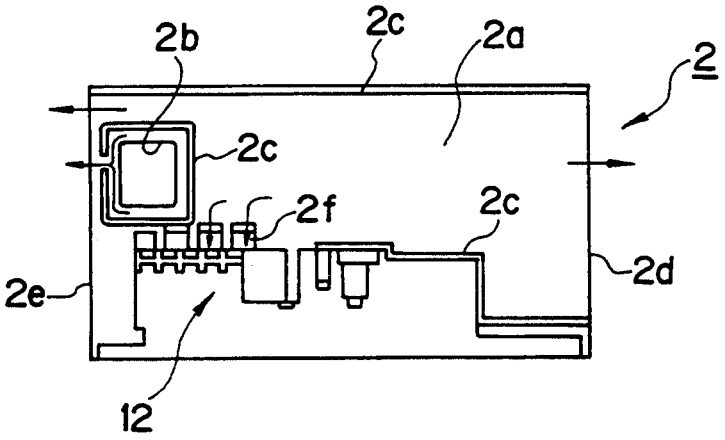
FIG. 5 is a plan view of a housing.

On the housing 2, a rib **2*c* is extendingly formed integrally with the housing 2, as shown in FIG. 5 (in FIG. 5, the gate plate 11 and the gate lever 16 shown in FIG. 3** are omitted).

The rib **2*c* is formed on front and rear peripheral edges of the upper surface 2*a* of the housing 2, and also formed to surround a cable hole 2*b* formed on the upper surface 2*a* of the housing 2. The rib 2*c* is not formed on the peripheral edges of the both sides 2*d* and 2*e* of the housing 2. A plurality of tilted faces 2*f* are formed on the peripheral edge of the coin slot 12, which extend into the coin slot 12**.

The rib **2*c* formed on the upper surface 2*a* of the housing 2 functions as a dam for guiding and discharging the liquid fell on the upper surface 2*a* of the housing 2 to the outside of the coin processing apparatus 1. As a result, the liquid fell on the upper surface 2*a* and around the cable hole 2*b* is guided along the rib 2*c* as shown by the arrows shown in FIG. 5, so that most of it flow toward the both sides 2*d* and 2*e* of the housing 2 and part of it is guided into the coin slot 12 through the tilted faces 2*f***.

A plurality of guide grooves 20 are formed on the main plate 10 which constitutes one of the members defining the coin slot 12 shown in FIG. 3 for downwardly guiding the liquid poured into the coin slot 12.

The guide grooves 20 are provided at predetermined pitches on the main plate 10 which constitutes the inner wall face of the coin slot 12. The guide grooves 20 include a plurality of tilted fins (convexities) 21 and a plurality of dams 22 vertically and downwardly extending at predetermined pitches from the lower surfaces of the respective fins 21.

Figure 6:
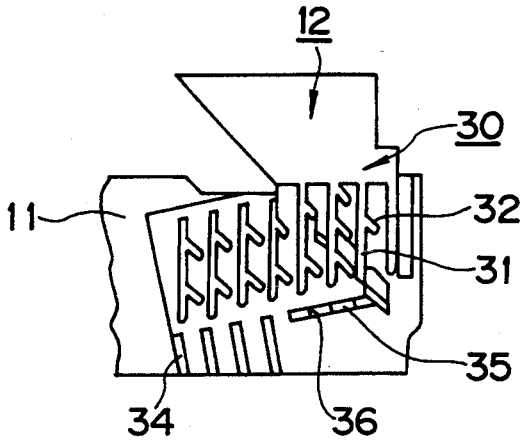
FIG. 6 is a rear view of an essential portion of a gate lever.

As shown in FIG. 6 which is a rear view of the essential portion of the gate plate 11 which constitutes the other of the members defining the coin slot 12, a plurality of guide grooves 30 are formed on the gate plate 11 so that the guide grooves 20 (FIG. 3) and the guide grooves 30 face with each other. The guide grooves 30 are configured by a plurality of fins (convexities) 31 formed vertically and downwardly along the coin slot 12 and a plurality of tilted dams 32 formed between adjacent fins 31. As shown in FIG. 6, a plurality of fins (convexities) 34 are formed on the lower portion of the gate plate 11 to guide the liquid falling from the guide groove 30 in the left portion of FIG. 6 toward the right portion of FIG. 6. The reference numeral 35 in FIG. 6 denotes a gate rail fixed to the gate plate 11, which constitutes a part of the first coin path 13 and has a plurality of slits 36 for guiding the falling liquid downwardly.

As shown in FIG. 3, a chute 40 is integrally formed at a lower portion of the main plate 10 and has a plurality of elongated holes 41 formed at a predetermined pitch. A plurality of protrusions 42 vertically and downwardly extending from a lower end of the chute 40 are provided. The leading edges of the plurality of protrusions 42 extend toward a liquid collector 50 disposed below the coin slot 12.

Figure 7:
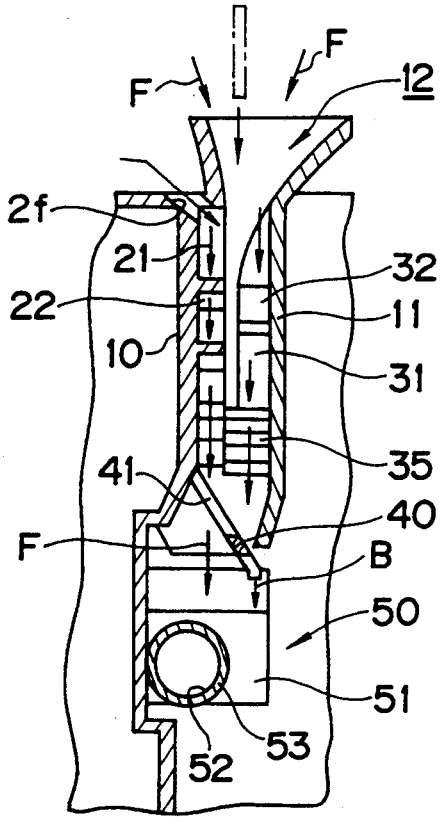
FIG. 7 is a schematic cross-sectional view taken along the line 1—1 of FIG. 1.

As shown in FIG. 7 which is an enlarged cross-sectional view taken along the line N—N of FIG. 1, the liquid collector 50 includes a box 51 having an open upper end, a hole 52 for discharging the collected liquid therethrough and a pipe 53 which communicates with the hole 52. The hole 52 and the pipe 53 are provided at the left side (FIG. 3) of the box 51 and integrally formed to constitute a discharge path. As shown in FIG. 2, the pipe 53 extends through the hole **2*g* formed on one side 2*e* of the housing 2 to the outside of the housing 2**.

Discharge of the liquid using the rib **2*c* and the tilted faces 2*f* formed on the upper surface 2*a* of the housing 2 shown in FIG. 5 and the liquid guide grooves 20 and 30 formed below the coin slot 12 shown in FIGS. 3 and 6** will be described.

As shown in FIG. 5, the liquid such as cleaning detergent fell on the upper surface **2*a* and around the cable hole 2*b* of the housing 2 is guided along the rib. 2*c* as shown by the arrows and the most of which is guided toward the both sides 2*d* and 2*e* of the housing 2 and discharged. The cable hole 2*b* itself is choked by a bundle of cables which are not shown. Part of the liquid fell on the upper surface 2*a* of the housing 2 is guided into the coin slot 12 through the tilted faces 2*f***.

As shown by the arrows in FIG. 7, the liquid guided into the coin slot 12 through the tilted faces **2*f* and liquid F directly poured into the coin slot 12 are guided through the path between the plurality of fins 21 formed on the main plate 10 and the plurality of fins 31 formed on the gate plate 11 and fall downward from the coin slot 12. At that time, the flow of the liquid F is intercepted by the respective dams 22 and 32 formed on the main plate 10 and the gate plate 11** while falling whereby a rapid fall of the liquid is prevented.

The liquid F guided through the path between the fins 21 formed on the main plate 10 and the fins 31 formed on the gate plate 11 is then guided to the elongated hole 41 in the shoot 40 and its vicinity and collected in the box 51 constituting the liquid collector 50. Since the liquid F falls into the box 51 while being intercepted by the dams 22 and 32, as mentioned above, a large amount of the liquid F does not rapidly fall into the box 51 and thus the collected liquid does not overflow from the box 51 and does not adhere to the vicinity of the box 51. The liquid F falling into the box 51 is rapidly discharged to the outside of the housing 2 through the discharge path constituted by the pipe 53 communicating with the hole 52 from the left side of the housing 2 shown in FIG. 2, as shown by the arrow F in FIG. 3.

Thus, according to the coin selecting section 5 mentioned above, even if adhesive liquid such as cleaning detergent is poured onto the upper surface **2*a* FIG. 5) of the housing 2 or poured into the coin slot 12, the liquid is discharged by the rib 2*c* to the outside of the housing 2 via the both sides 2*d* and 2*e* of the housing 2 and is also rapidly discharged through the liquid collector 50 disposed at the lower end of the coin slot 12 to the outside of the housing 2 of the coin processing apparatus 1. Therefore, no liquid adheres to various selection members disposed inside of the housing 2 and inside of the coin selecting section 5** and thus the function of the selection sections is not deteriorated.

Figure 8:
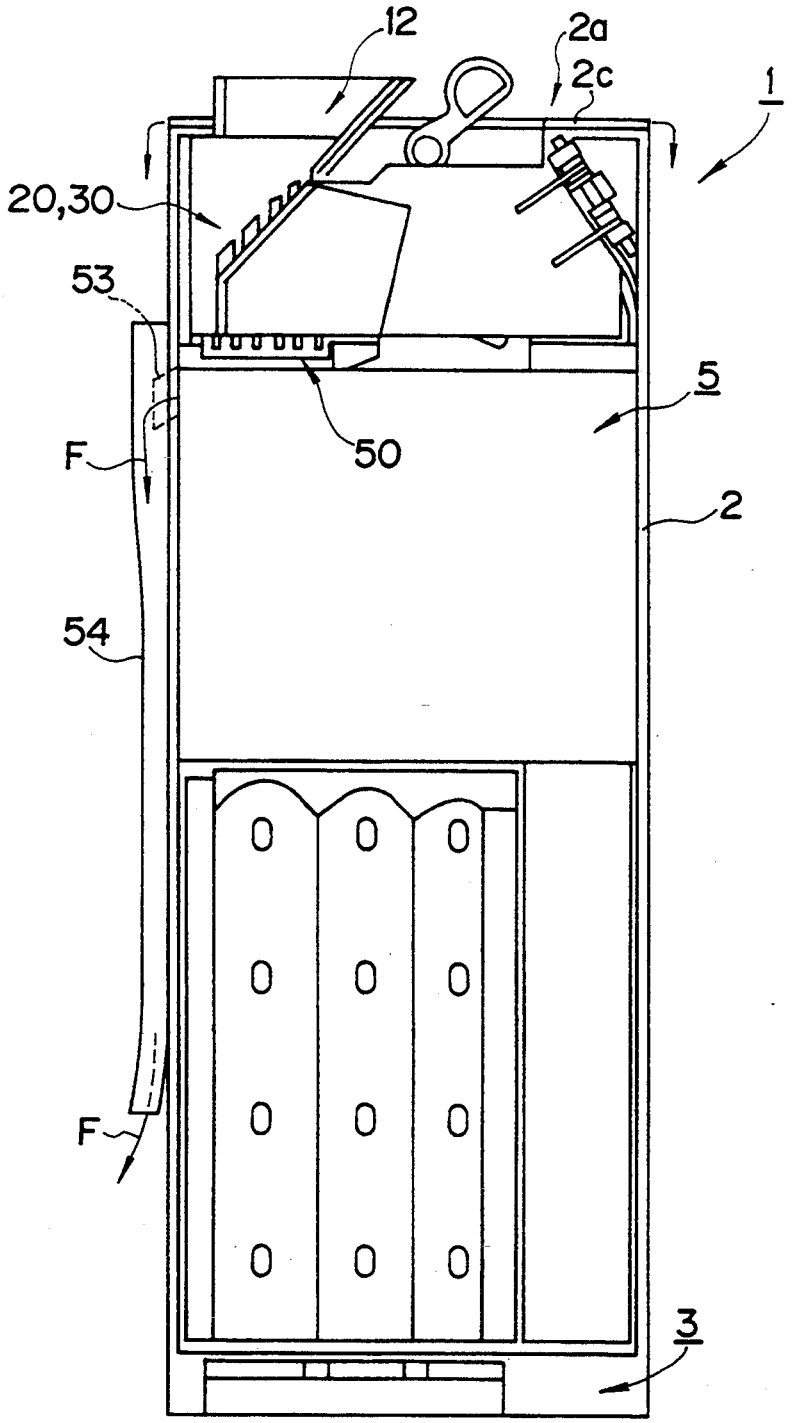
FIG. 8 is a front view of the coin processing apparatus according to the present invention provided with a liquid discharge tube attached to the side of the coin processing apparatus.
Figure 9:
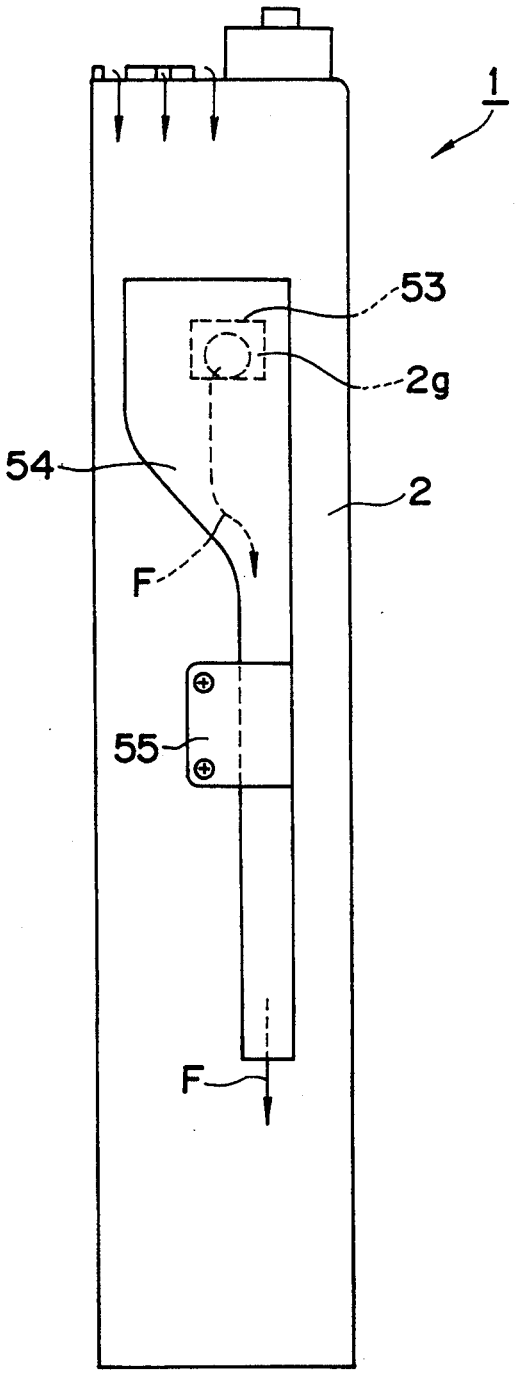
FIG. 9 is a left side view of the coin processing apparatus of FIG. 8.

By disposing on the left side of the housing 2 a tube 54 which communicates with the pipe 53 of the liquid collector 50 as shown in FIGS. 8 and 9 which show the front and left side of the coin processing apparatus 1 where the same reference numerals are used to denote the same elements as that in FIG. 1, the liquid F discharged through the pipe 53 from the liquid collector 50 is rapidly discharged through the tube 54 to the outside of a device, such as an automatic vending machine, which incorporates the coin processing apparatus 1. A reference numeral 55 in FIG. 9 denotes a fastener which secures the tube 54 to the side of the housing 2.

The coin selecting function of the coin selecting section 5 mentioned above and its structure will be described below in more detail.

Figure 10:
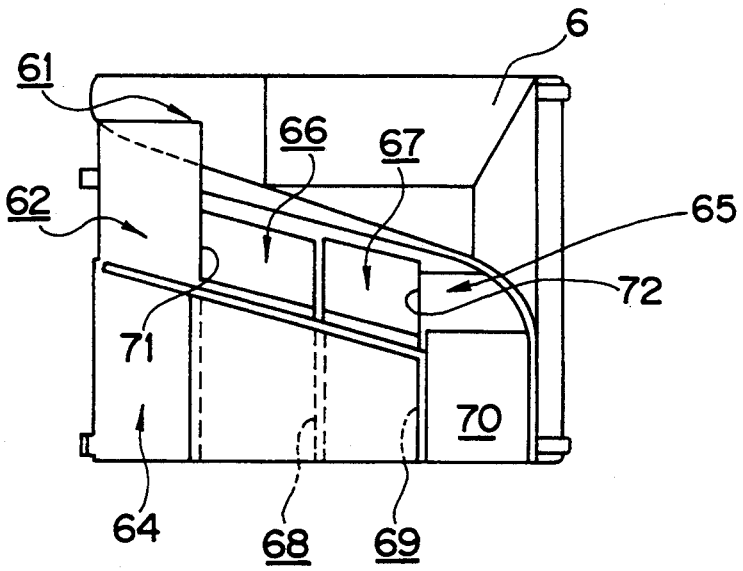
FIG. 10 is a rear view of a chute plate.
Figure 11:
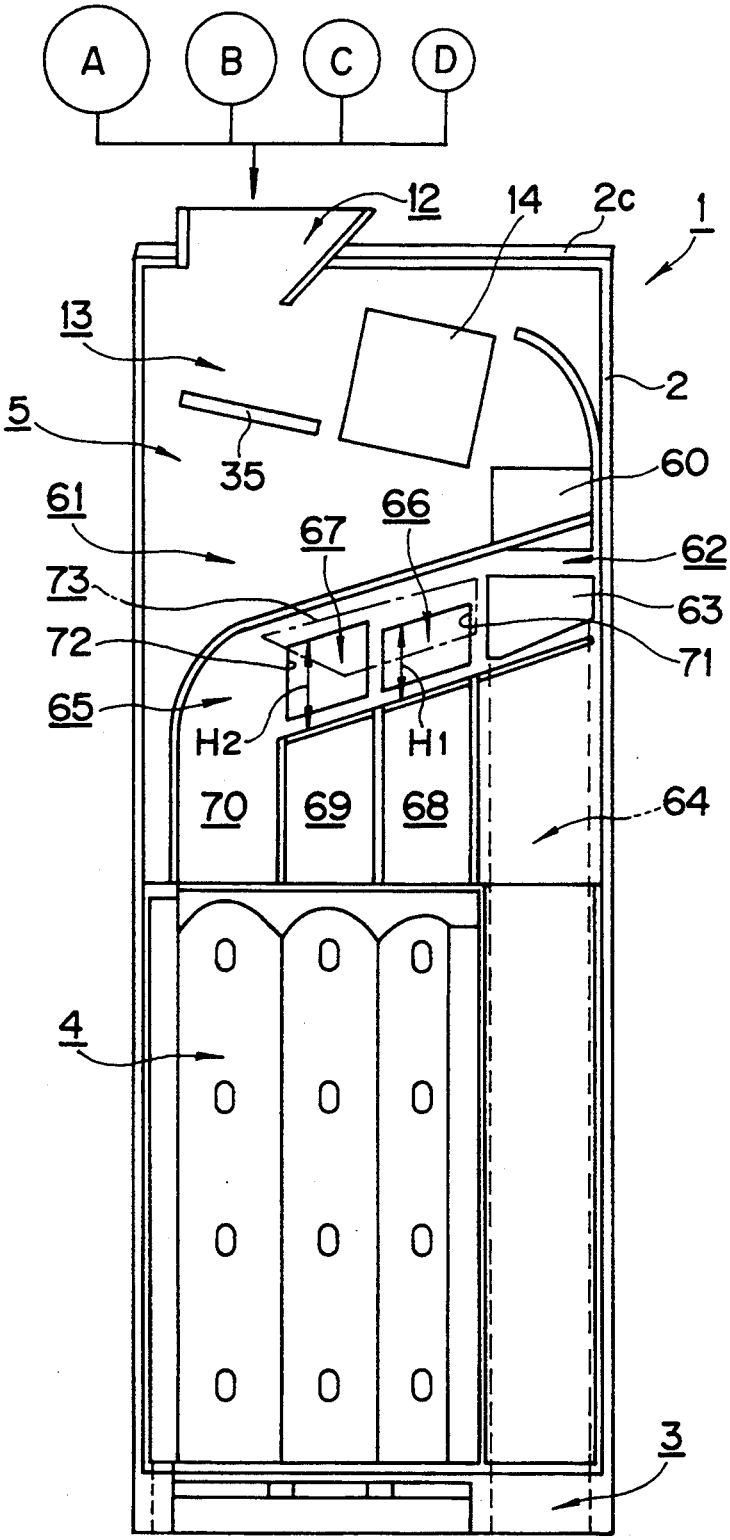
FIG. 11 is a conceptual view of the coin processing apparatus which illustrates the coin selective operation of the coin selecting section.

FIG. 11 is a conceptual view of the coin processing apparatus i used for simply explaining the coin selecting function of the coin selecting section 5. The same numerals in FIG. 11 and FIGS. 1 to 10 denote the same elements. In FIG. 11, illustration of the liquid discharge mechanism, such as, the liquid guide grooves 20 and 30 shown in FIGS. 3 to 7 is omitted.

The coin selecting section 5 selects four kinds of coins (genuine coins) A, B, C and D having different diameters and false coins. The diameter of the coin A is set to be maximum and the diameters of the coins B, C and D are set to be smaller in this order than the diameter of the coin A, that is, the diameters are set to be $A>B>C>D$.

The first coin path 13 is formed tilted rightward in FIG. 11 immediately below the coin slot 12 in the coin selecting section 5, and the coil sensor 14 is provided halfway through the first coin path 13 so as to determine whether the coin is a genuine coin, and the denomination of the coin if the coin is a genuine one.

A first lever 60 is provided at the terminal end of the first coin path 13 to separate genuine coins from false coins and to guide them to corresponding separate coin paths. The first lever 60 is a lever of the type which is opened and closed at the upper end in a direction perpendicular to the plane of FIG. 11 about a lower end thereof. By the first lever 60, the first coin path 13 is caused to communicate at the terminal end with a second coin path 61 which guides only false coins or with a third coin path 62 which guides only genuine coins. The first lever 60 is usually closed at the upper end and, when operated, opens at the upper end for a predetermined rotational angle.

Provided halfway through the third coin path 62 is a second lever 63 by which a group of genuine coins A, B, C and D guided to the third coin path 62 is separated into the coin A having the maximum diameter and a group of coins B, C and D having diameters smaller than the diameter of the coin A.

The third coin path 62 is caused by the second lever 63 to communicate with a fourth coin path 64 formed on the innermost side of the inner wall face of the housing 2 and which guides the coin A only, or a fifth coin path 65 formed tilted leftward in FIG. 11 and which guides the group of coins B, C and D other than the coin A. The second lever 63 is also of the type which is opened and closed at the upper end in a direction perpendicular to the plane of FIG. 11 about the lower end thereof as same with the first lever 60. The second lever 63 is usually opened at its upper end for a predetermined rotational angle and, when operated, closes at the upper end.

Disposed in the fifth coin path 65 are first and second rail-type coin selection means 66 and 67 which select rolling coins B, C and D in accordance with their diameters. The fifth coin path 65 is caused to communicate at a middle point by the first rail-type coin selection means 66 with a sixth coin path 68 while the downstream of the fifth coin path 65 is caused to communicate by the second rail-type coin selection means 67 with seventh or eighth coin paths 69 or 70.

The first and second rail-type coin selection means 66 and 67 include rectangular windows 71 and 72, respectively, provided on the side wall of the fifth coin path 65 (more particularly, on the side wall of the chute plate 6 as shown in FIG. 10) and a convexity 73 (shown by dot-dashed line, more particularly, on the inner wall face of the housing) which pushes down coins rolling in the fifth coin path 65 toward the windows 71 and 72. The height H1 of the window 71 constituting a part of the first rail-type coin selection means 66 is slightly larger than the diameter of the coin D having the smallest diameter among the coins B, C and D and smaller than the diameter of the coin C which is the next smallest. The height H2 of the window 72 constituting a part of the second rail-type coin selection means 67 is slightly larger than the diameter of the coin C and smaller than the diameter of the coin B.

Therefore, when the coins B, C and D which have decreasing diameters in this order (B>C>D) are guided into the fifth coin math 65, the coins B, C and D are pushed down by the convexity 73 against the windows 71 and 72 while rolling. At this time, since the diameters of the coins B and C are larger than the height H1 of the window 71, those coins mass by the window 71 while since the diameter of the coin D is smaller than the height H1, the coin D is tilted into the window 71 while changing its posture and falls into the sixth coin path 68 formed below the window 71. When the coins B and C are passing by the window 72, the coin B passes by the window 72 because the diameter of the coin B is larger than the height H2 of the window 72 while since the diameter of the coin C is smaller than the height H2 of the window 72, the coin C is tilted into the window 72 while changing its posture and falls into the seventh coin path 69 formed below the window 72. The coin B having the maximum diameter among the coins B, C and D guided into the fifth coin math 65 passes the windows 71 and 72 and falls into the eighth coin math 70 communicating with the lower end of the fifth coin path 65.

The respective elements having the coin selecting function, which are the second coin math 61, the third coin path 62, the fifth coin path 65, the sixth coin path 68, the seventh coin path 69, the eighth coin path 70, the first and second rail-type coin selecting means 66 and 67, and the windows 71 and 72, are formed on the back side of the shoot plate 6 which covers the upper portion of the housing 2, as seen from the rear view of the chute plate 6 shown in FIG. 10. As shown in FIG. 1, when the chute plate 6 is mounted on the predetermined position of the housing 2, the respective coin selecting elements are formed on the inner wall face of the housing 2 and the chute plate 6 which is the cover covering the inner wall face of the housing 2.

The selective operation of the coin selecting section 5 will now be described in more detail.

Figure 12:
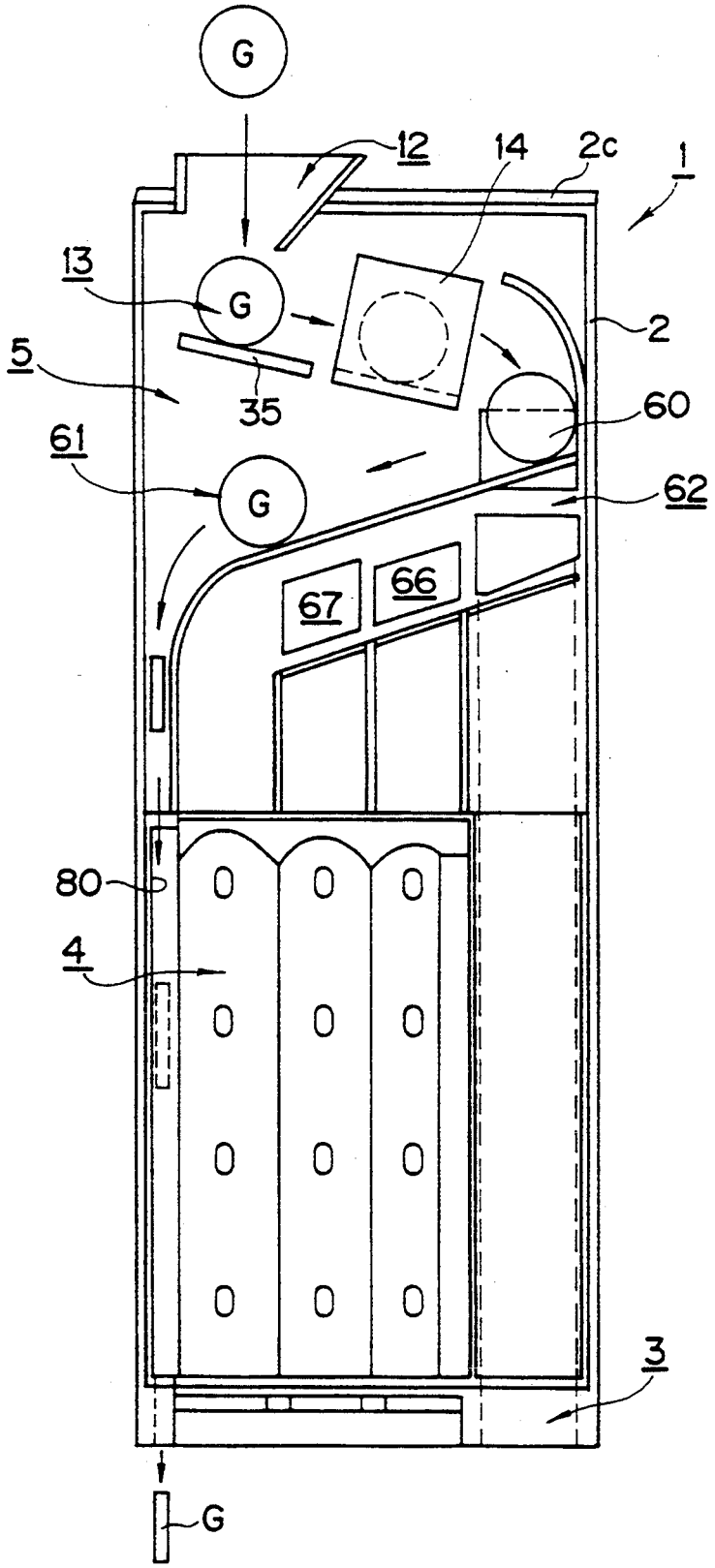
FIG. 12 is a conceptual view of the coin processing apparatus which illustrates the coin selective operation of the coin selecting section.

In FIGS. 12 and 11, the same elements are identified with the same reference numerals. In FIG. 12, when the coin G put into the coin slot 12 is determined as a false one on the basis of a detection signal from the coil sensor 14, the first lever 60, in response to the detection signal, maintains its initial position at which the upstream portion of the second coin path 61 is opened and simultaneously the upstream portion of the third coin path 62 is closed (i.e., the first lever 60 is initially closed). In response, the false coin G rolling in the first coin path 13 is guided by the first lever 60 into the second coin path 61 and further returned to the coin return outlet (not shown) through a false coin discharge shoot 80 formed on the left side of the housing 2 of the coin processing apparatus 1.

Figure 13:
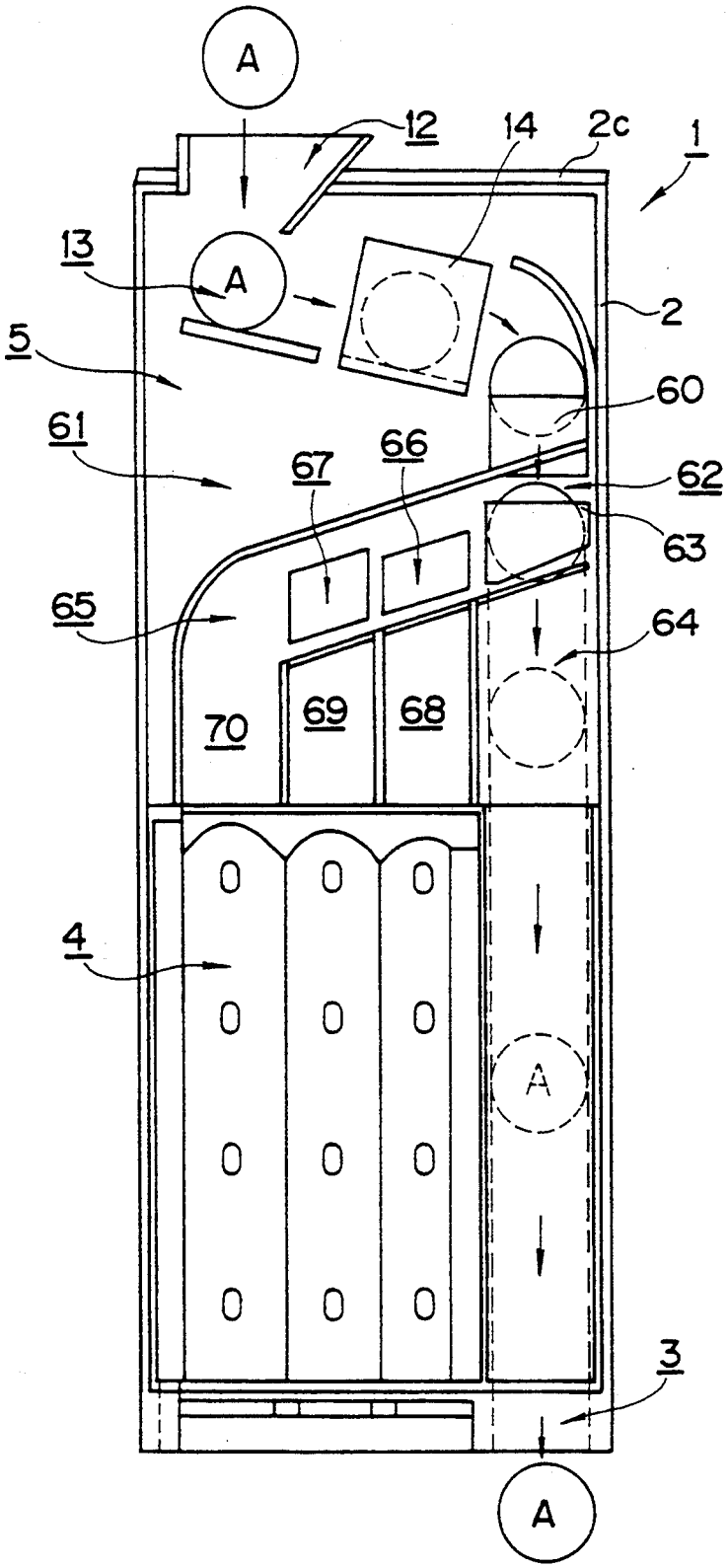
FIG. 13 is a conceptual view of the coin processing apparatus which illustrates the coin selective operation of the coin selecting section.

In FIGS. 13 and 11, the same elements are identified with the same reference numerals. In FIG. 13, when a coin is put into the coin slot 12 and determined as the coin A on the basis of a detection signal from the coil sensor 14, the first lever 60 is actuated (i.e., the upper end of the first lever 60 is opened for the predetermined angle) on the basis of the detection signal so as to close the upstream portion of the second coin path 61 and simultaneously to open the upstream portion of the third coin path 62. The second lever 63, on the basis of the detection signal from the coil sensor 14, maintains its initial position at which the upstream portion of the fifth coin path 65 is closed and the upstream portion of the fourth coin path 64 is opened (i.e., the upper portion of the second lever 63 is initially opened for the predetermined angle).

The coin A rolling in the first coin path 13 is then guided by the first lever 60 into the third coin path 62, then into the fourth coin path 64 formed on the innermost side of the inner wall face of the housing 2 by the second lever 63 and finally accommodated in a cash box (not shown).

Figure 14:
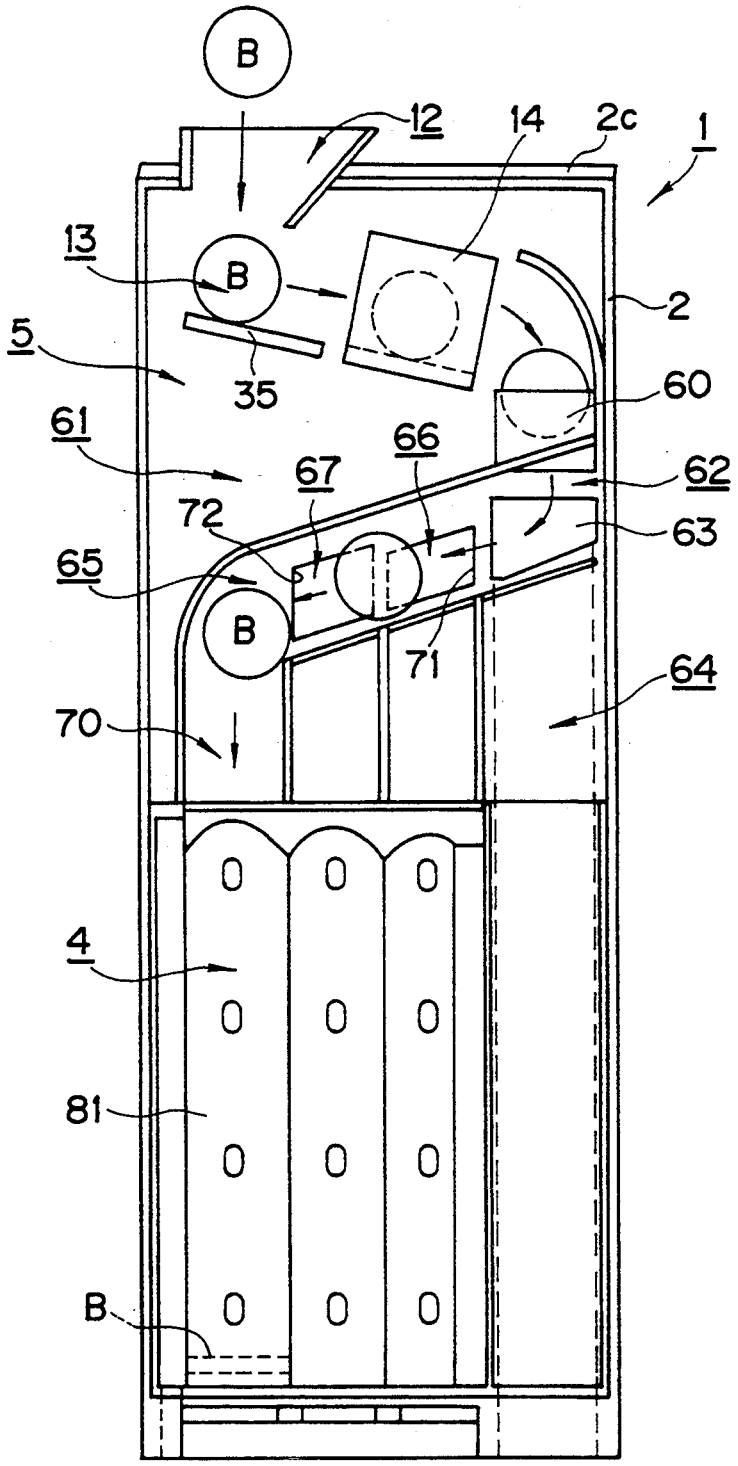
FIG. 14 is a conceptual view of the coin processing apparatus which illustrates the coin selective operation of the coin selecting section.

In FIGS. 14 and 11, the same elements are identified with the same reference numerals. In FIG. 14, when a coin is put into the coin slot 12 and determined as the coin B on the basis of a detection signal from the coil sensor 14, the first lever 60 is actuated to opened on the basis of the detection signal so as to close the upstream portion of the second coin path 61 and simultaneously to open the upstream portion of the third coin path 62. The second lever 63 is also actuated (i.e., the second lever 63 being in its initial position is closed) on the basis of the detection signal from the coil sensor 14 so as to open the upstream portion of the fifth coin path 65 and to close the upstream portion of the fourth coin path 64. The coin B rolling in the first coin path 13 is then guided by the first lever 60 into the third coin path 62, and then into the fifth coin path 65 by the second lever 63.

The coin B then passes by the windows 71 and 72 which constitute the first and second rail type coin selection means 66 and 67, respectively, falls within the eighth coin path 70 formed at the end of the fifth coin path 65 and is stored in the coin tube 81 of the coin accommodating section 4 disposed at the lower end of the eighth coin path 70.

Figure 15:
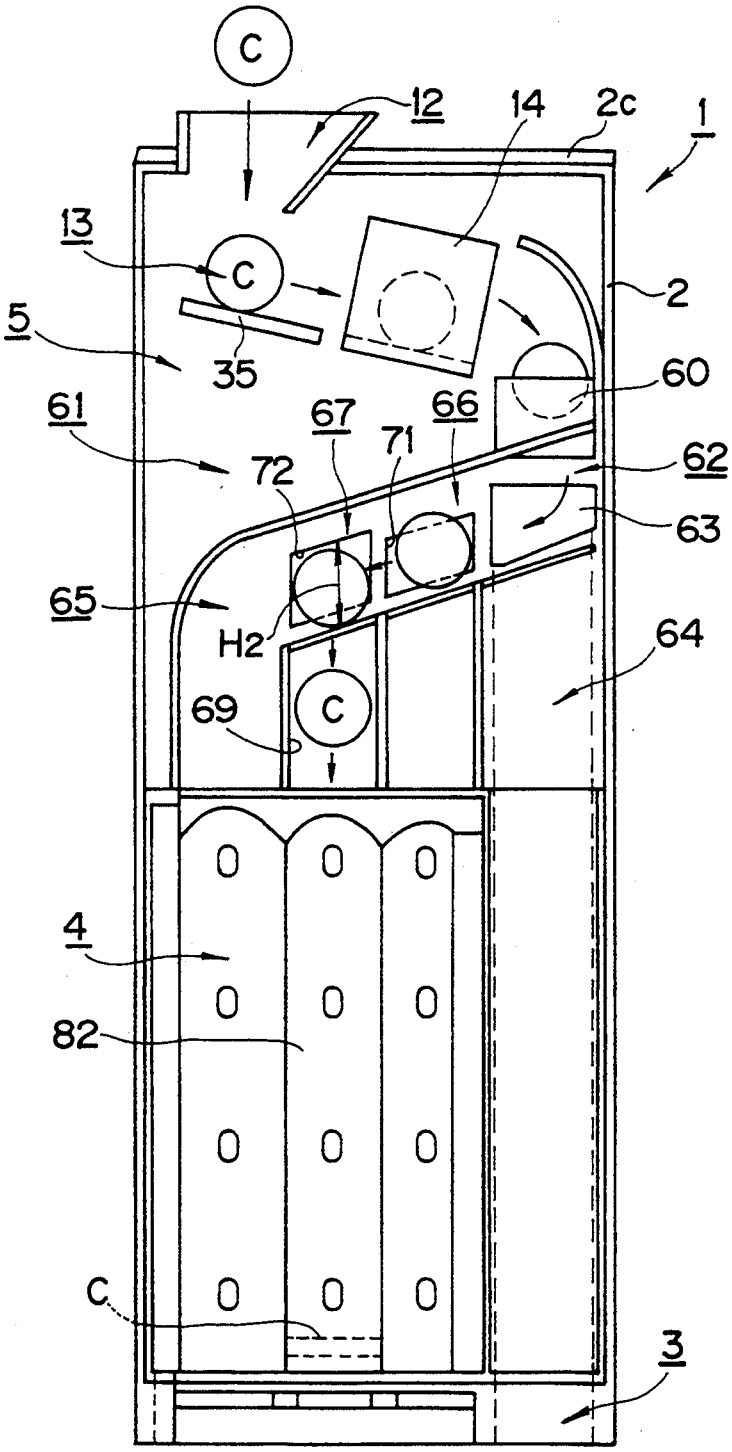
FIG. 15 is a conceptual view of the coin processing apparatus which illustrates the coin selective operation of the coin selecting section.

In FIGS. 15 and 11, the same elements are identified with the same reference numerals. In FIG. 15, when a coin is put into the coin slot 12 and determined as the coin C on the basis of a detection signal from the coil sensor 14, the first lever 60 is actuated to open on the basis of the detection signal so as to close the upstream portion of second coin path 61 and simultaneously to open the upstream portion of the third coin path 62. The second lever 63 is also actuated to close on the basis of the detection signal from the coil sensor 14 so as to open the upstream portion of the fifth coin path 65 and to close the upstream portion of the fourth coin path 64. The coin C rolling in the first coin path 13 is then guided by the first lever 60 into the third coin path 62, and then into the fifth coin path 65 by the second lever 63.

The coin C then passes by the window 71 which constitutes the first rail-type coin selection means 66, tilts into the window 72 which constitutes the second rail-type coin selection means 67 since the coin C is smaller in diameter than the height H2 of the window 72, while changing its posture, falls into the seventh coin path 69 formed below the window 72, and is stored in the coin tube 82 of the coin accommodating section 4 disposed at the lower end of the seventh coin path 69.

Figure 16:
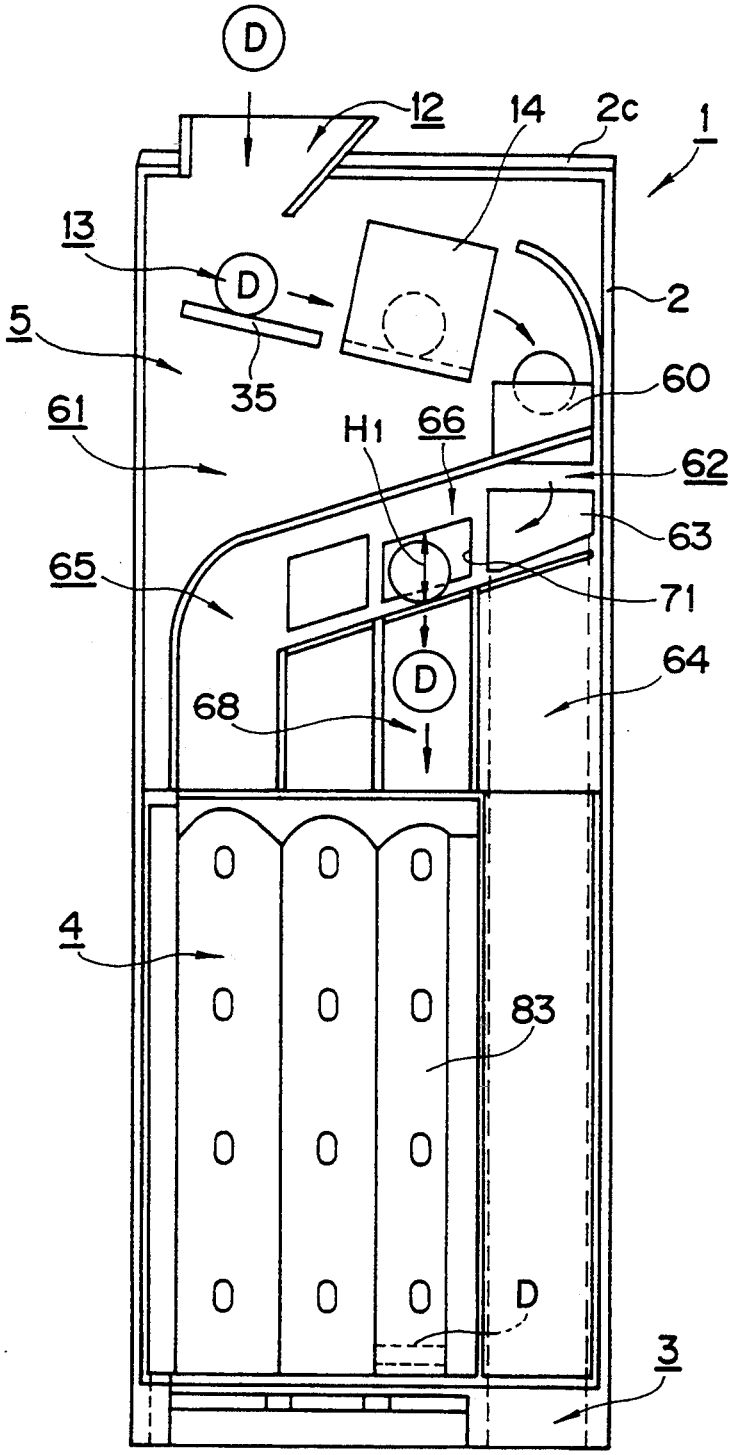
FIG. 16 is a conceptual view of the coin processing apparatus which illustrates the coin selective operation of the coin selecting section.
Figure 17:
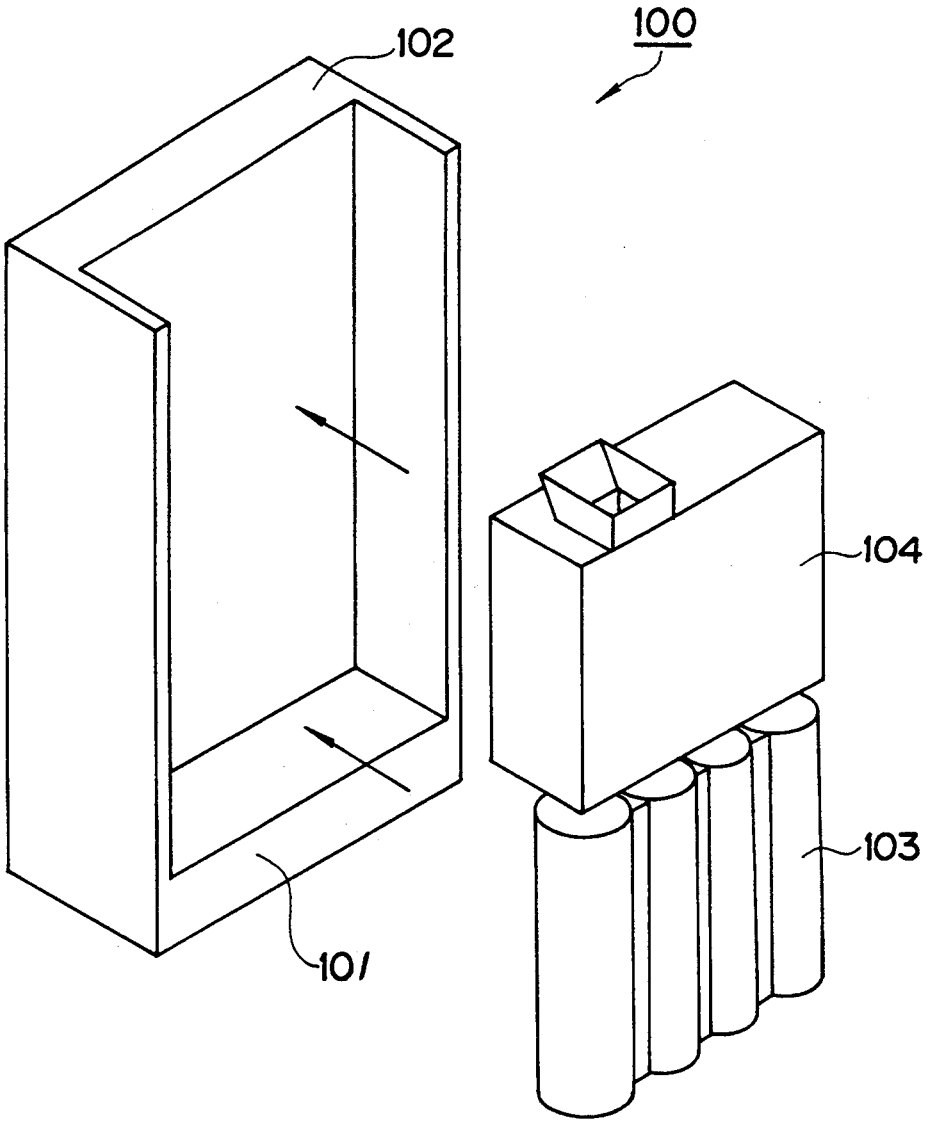
FIG.17 (PRIOR ART)
FIG. 17 is a schematic perspective view of a conventional coin processing apparatus.

In FIGS. 16 and 11, the same elements are identified with the same reference numerals. In FIG. 16, when a coin is put into the coin slot 12 and determined as the coin D on the basis of a detection signal from the coil sensor 14, the first lever 60 is actuated to open on the basis of the detection signal so as to close the upstream portion of the second coin path 61 and simultaneously to open the upstream portion of the third coin path 62. The second lever 63 is also actuated to close on the basis of the detection signal from the coil sensor 14 so as to open the upstream portion of the fifth coin path 65 and simultaneously to close the upstream portion of the fourth coin path 64. The coin D rolling in the first coin path 13 is then guided by the first lever 60 into the third coin path 62, and then into the fifth coin path 65 by the second lever 63.

When the coin D enters the first rail type coin selection means 66, it tilts into the window 71 since the coin D is smaller in diameter than the height H1 of the window 71, while changing its posture, falls into the sixth coin path 68 formed below the window 71, and is stored in the coin tube 83 of the coin accommodating section 4 disposed at the lower end of the sixth coin path 68.

While in the above embodiments the genuine coins are illustrated as four kinds of coins A, B, C and D only different in diameter, the coin A is preferably a coin of the maximum denomination among the usable genuine coins since the coin A is accommodated through the fourth coin path 64 into the cash box (not shown).

The respective coins B, C and D selected by the coin selecting section 5, piled and accommodated in the respective coin tubes 81, 82 and 83 of the coin accommodating section 4 are paid out as change by a well-known payment unit constituting the coin payment section 3 such as, for example, a pay-out slider or a pay-out plunger from the lower end of the housing 2 of the coin processing apparatus 1 to the coin return outlet (not shown).

As described above, according to the coin processing apparatus 1 of the present invention, since the coin selecting section 5 is defined by the inner wall face of the housing 2 which constitutes the main body and by the cover (i.e., the gate plate 11 and the shoot plate 6) which covers the inner wall face of the housing 2 and the coin payment section 3 is integrally formed with the housing 2 on the lower portion of the housing 2, the composing elements required in the conventional apparatus, such as housings for respectively accommodating the coin selecting unit and the coin accommodating unit as independent parts and mechanical and electrical connecting parts necessary for detachably mounting the coin selecting unit to the coin payment unit are not required. Thus, not only the structure of the apparatus is simplified but also the number of parts are reduced whereby a cheeper coin processing apparatus can be provided.

Further, according to the coin processing apparatus of the present invention, since the rib **2*c* for guiding the liquid fell on the upper surface of the housing 2 to the both sides 2*d* and 2*e* of the housing 2 is formed on the upper surface of the housing 2 and also the liquid poured into the coin slot 12 of the coin selecting section 5 is rapidly discharged through the guide grooves 20 and 30, the collector 50 and the discharge path to the outside of the hosing 2, even if adhesive liquid such as cleaning detergent is poured into the coin slot of the device such as the vending machine, it does not adhere to the various elements disposed within the coin processing apparatus 1**. Therefore, the coin processing apparatus can be effectively protected from wicked mischief such as pouring in liquid and thus the deterioration in the functions of the coin processing apparatus can be prevented.

The present invention is practicable in various forms without departing from the spirit or main features of the present invention. Therefore, the above embodiments should be described only for illustrative purposes and should not be restrictedly construed. The scope of the present invention is shown only by the attached claims and should not be bound by the specification text. Changes and modifications within the equivalent scope of the claims are contemplated as falling within the scope of the invention.

What is claimed is:

1. A coin processing apparatus including a coin selecting section having a coin slot, for determining whether coins put in the coin slot are genuine or not and denominations of coins determined as genuine and guiding false coins to a predetermined coin path assigned for the false coins and the genuine coins to corresponding predetermined coin paths in accordance with the respective denominations, a coin accommodating section for accommodating the genuine coins selected by the coin selecting section separately for the respective denominations, and a coin payment section for paying out coins having denominations corresponding to an amount of change from the coin accommodating section, the coin processing apparatus comprising:

a rib formed on an upper surface of a single housing, for guiding liquid falling on the upper surface of the housing to both sides of the housing;

a guide groove formed on an inner wall face of a coin path communicating directly with the coin slot, for guiding the liquid downward;

a liquid collector provided below the coin path communicating directly with the coin slot, for collecting the liquid falling along the guide groove;

a tilted face formed between the upper surface of the housing and the coin slot of the coin selecting section, the tilted face being adapted for guiding the liquid falling on the upper surface of the housing to the coin slot;

a discharge path communicating with the liquid collector for discharging the liquid collected in the liquid collector to the outside of the housing, whereby the liquid falling on the upper surface of the housing is discharged to the both sides of the housing by the rib and the liquid poured into the coin slot is discharged to the outside of the housing through the guide groove, the liquid collector and the discharge path.

2. The coin processing apparatus according to claim 1, wherein the guide groove is defined by a plurality of tilted convexities, and wherein a plurality of dams are provided at a predetermined pitch between adjacent convexities for temporarily stopping a flow of the liquid.

3. The coin processing apparatus according to claim 2, wherein the dams extend in a vertical and downward direction.

4. The coin processing apparatus according to claim 1, wherein the liquid collector comprises a box olden at an upper end thereof.

5. The coin processing apparatus according to claim 1, wherein the discharge path comprises a hole formed in the liquid collector and a pipe communicating with the hole.

6. The coin processing apparatus according to claim 1 further comprising a tube provided on a side of the housing for discharging the liquid, the tube communicating at an upper end thereof with a downstream end of the discharge path communicating with the liquid collector.

7. A coin processing apparatus including a coin selecting section having a coin slot, for determining whether coins put in the coin slot are genuine or false and denominations of coins determined as genuine and guiding false coins to a predetermined coin path assigned for the false coins and the genuine coins to corresponding predetermined coin paths in accordance with the respective denominations, a coin accommodating section for accommodating the genuine coins selected by the coin selecting section separately for the respective denominations, and a coin payment section for paying out coins having denominations corresponding to an amount of change from the coin accommodating section, the coin processing apparatus comprising;

a single housing provided with the coin payment section at a lower portion thereof and also provided with a part of the coin selecting section on an inner wall face thereof;

a cover for covering the inner wall face of the housing, the cover being provided with another part of the coin selecting section on a back face thereof;

a rib formed on an upper surface of the housing, for guiding liquid falling on the upper surface of the housing to both sides of the housing;

a guide groove formed on an inner wall face of a coin path communicating directly with the coin slot, for guiding the liquid downward;

a liquid collector provided below the coin path communicating directly with the coin slot, for collecting the liquid falling along the guide groove;

a tilted face formed between the upper surface of the housing and the coin slot of the coin selecting section, the tilted face being adapted for guiding the liquid falling on the upper surface of the housing to the coin slot;

a discharge path communicating with the liquid collector for discharging the liquid collected in the liquid collector to the outside of the housing;

whereby the liquid falling on the upper surface of the housing is discharged to both sides of the housing by the rib and the liquid poured into the coin slot is discharged to the outside of the housing through the guide groove, the liquid collector and the discharge path.

8. The coin processing apparatus according to claim 7, wherein the cover comprises a gate plate and a chute plate which cover the upper portion of the single housing.

9. The coin processing apparatus according to claim 7, wherein the coin accommodating section is detachably disposed between the coin selecting section and the coin payment section in the single housing.

10. The coin processing apparatus according to claim 7, wherein the coin accommodating section comprises a plurality of coin tubes.

11. The coin processing apparatus according to claim 7, wherein the coin selecting section comprises:

a coil sensor for determining whether coins put in the coin slot are genuine or not and denominations of coins determined as the genuine coins:

a first lever for separating the put-in coins into a group of genuine coins A, B, C and D different in diameters and the false coin on the basis of a detection signal from the coil sensor, and for guiding the coins into appropriate ones of separate coin paths respectively assigned for the group of genuine coins and the false coin;

a second lever for separating on the basis of the detection signal from the coil sensor the coins A, B, C and D determined as genuine coins into the coin A and a group of the genuine coins other than the coin A, and for separately guiding the coin A and the group of the genuine coins other than the coin A into appropriate ones of separate coin paths respectively provided for the coin A and the group of genuine coins other than the coin A;

first rail type coin selecting means for further separating the coins separated into the group of the genuine coins B, C and D other than the coin A into the coin D and a group of the coins B and C in accordance with their diameters and for guiding the coins to appropriate ones of separate coin paths respectively provided for the coin D and the group of the coins B and C; and second rail type coin selecting means for further separating the coins separated into the group of the genuine coins B and C into the coin B and the coin C in accordance with their diameters and for guiding the coins B and C to appropriate ones of separate coin paths respectively provided for the coin B and the coin C.

12. The coin processing apparatus according to claim 7, wherein the guide groove is defined by a plurality of tilted convexities, and wherein a plurality of dams are provided at a predetermined pitch between adjacent convexities for temporarily stopping a flow of the liquid.

13. The coin processing apparatus according to claim 12, wherein the dams extend in a vertical and downward direction.

14. The coin processing apparatus according to claim 7, wherein the liquid collector includes a box open at an upper end thereof.

15. The coin processing apparatus according to claim 7, wherein the discharge path includes a hole formed in the liquid collector and a pipe communicating with the hole.

16. The coin processing apparatus according to claim 7, further comprising a tube provided on a side of the coin processing apparatus for discharging the liquid, the tube communicating at an upper end thereof with a downstream end of the discharge path communicating with the liquid collector.

17. A coin processing apparatus including a coin selecting section having a coin slot, for determining whether coins put in the coin slot are genuine or not and denominations of coins determined as genuine and guiding false coins to a predetermined coin path assigned for the false coins and the genuine coins to corresponding predetermined coin paths in accordance with the respective denominations, a coin accommodating section for accommodating the genuine coins selected by the coin selecting section separately for the respective denominations, and a coin payment section for paying out coins having denominations corresponding to an amount of change from the coin accommodating section, the coin selecting section, the coin accommodating section and the coin payment section being disposed in a single housing, the coin processing apparatus comprising:

a rib formed on an upper surface of the single housing, for guiding liquid falling on the upper surface of the housing to both sides of the housing;

a guide groove formed on an inner wall face of a coin path communicating directly with the coin slot, for guiding the liquid downward;

a liquid collector provided below the coin path communicating directly with the coin slot, for collecting the liquid falling along the guide groove;

a discharge path communicating with the liquid collector for discharging the liquid collected in the liquid collector to the outside of the housing; and a tilted face formed between the upper surface of the housing and the coin slot of the coin selecting section, the tilted face being adapted for guiding the liquid fell on the upper surface of the housing to the coin slot, whereby the liquid falling on the upper surface of the housing is discharged to the both sides of the housing by the rib and the liquid poured into the coin slot is discharged to the outside of the housing through the guide groove, the liquid collector and the discharge path.

18. The coin processing apparatus according to claim 17, wherein the guide groove is defined by a plurality of tilted convexities, and wherein a plurality of dams are provided at a predetermined pitch between adjacent convexities for temporarily stopping the flow of the liquid.

19. The coin processing apparatus according to claim 18, wherein the dams extend in a vertical and downward direction.

20. The coin processing apparatus according to claim 17, wherein the liquid collector comprises a box open at an upper end thereof.

21. The coin processing apparatus according to claim 17, wherein the discharge path comprises a hole formed in the liquid collector and a pipe communicating with the hole.

22. The coin processing apparatus according to claim 17 further comprising a tube provided on a side of the housing for discharging the liquid, the tube communicating at an upper end thereof with a downstream end of the discharge path communicating with the liquid collector.

23. A coin processing apparatus including a coin selecting section having a coin slot, for determining whether coins put in the coin slot are genuine or false and denominations of coins determined as genuine and guiding false coins to a predetermined coin path assigned for the false coins and the genuine coins to corresponding predetermined coin paths in accordance with the respective denominations, a coin accommodating section for accommodating the genuine coins selected by the coin selecting section separately for the respective denominations, and a coin payment section for paying out coins having denominations corresponding to an amount of change from the coin accommodating section, the coin processing apparatus comprising:

a single housing provided with the coin payment section at a lower portion thereof and also provided with part of the coin selecting section on an inner wall face thereof;

a cover for covering the inner wall face of the housing, the cover being provided with another part of the coin selecting section on a back face thereof;

a rib formed on an upper surface of the housing, for guiding liquid fell on the upper surface of the housing to both sides of the housing;

a guide groove formed on an inner wall face of a coin path communicating directly with the coin slot, for guiding the liquid downward;

a liquid collector provided below the coin path communicating directly with the coin slot, for collecting the liquid falling along the guide groove;

a discharge path communicating with the liquid collector for discharging the liquid collected in the liquid collector to the outside of the housing; and a tilted face formed between the upper surface of the housing and the coin slot of the coin selecting section, the tilted face being adapted for guiding the liquid fell on the upper surface of the housing to the coin slot, whereby the liquid falling on the upper surface of the housing is discharged to both sides of the housing by the rib and the liquid poured into the coin slot is discharged to the outside of the housing through the guide groove, the liquid collector and the discharge path.

24. The coin processing apparatus according to claim 23, wherein the cover comprises a gate plate and a chute plate which cover the upper portion of the single housing.

25. The coin processing apparatus according to claim 23, wherein the coin accommodating section is detachably disposed between the coin selecting section and the coin payment section in the single housing.

26. The coin processing apparatus according to claim 23, wherein the coin accommodating section comprises a plurality of coin tubes.

27. The coin processing apparatus according to claim 23, wherein the coin selecting section comprises:

a coil sensor for determining whether coins put in the coin slot are genuine or not and denominations of coins determined as the genuine coins;

a first lever for separating the put-in coins into a group of genuine coins A, B, C and D different in diameters and the false coin on the basis of a detection signal from the coil sensor, and for guiding the coins into appropriate ones of separate coin paths respectively assigned for the group of genuine coins and the false coin;

a second lever for separating on the basis of the detection signal from the coil sensor the coins A, B, C and D determined as genuine coins into the coin A and a group of the genuine coins other than the coin A, and for separately guiding the coin A and the group of the genuine coins other than the coin A into appropriate ones of separate coin paths respectively provided for the coin A and the group of genuine coins other than the coin A;

first rail type coin selecting means for further separating the coins separated into the group of the genuine coins B, C and D other than the coin A into the coin D and a group of the coins B and C in accordance with their diameters and for guiding the coins to appropriate ones of separate coin paths respectively provided for the coin D and the group of the coins B and C; and second rail type coin selecting means for further separating the coins separated into the group of the genuine coins B and C into the coin B and the coin C in accordance with their diameters and for guiding the coins B and C to appropriate ones of separate coin paths respectively provided for the coin B and the coin C.

28. The coin processing apparatus according to claim 23, wherein the guide groove is defined by a plurality of tilted convexities, and wherein a plurality of dams are provided at a predetermined pitch between adjacent convexities for temporarily stopping the flow of the liquid.

29. The coin processing apparatus according to claim 23, wherein the dams extend in a vertical and downward direction.

30. The coin processing apparatus according to claim 23, wherein the liquid collector includes a box open at an upper end thereof.

31. The coin processing apparatus according to claim 23, wherein the discharge path includes a hole formed in the liquid collector and a pipe communicating with the hole.

32. The coin processing apparatus according to claim 30 further comprising a tube provided on a side of the housing for discharging the liquid, the tube communicating at an upper end thereof with a downstream end of the discharge path communicating with the liquid collector.

* * * * *